United States Patent [19]

Hsieh

[11] 4,301,003

[45] Nov. 17, 1981

[54] PHOSPHATE FLOTATION WITH DIBASIC ACIDS

[75] Inventor: Shuang-shii Hsieh, Florence, Ala.

[73] Assignee: Tennessee Valley Authority, Muscle Shoals, Ala.

[21] Appl. No.: 165,999

[22] Filed: Jul. 7, 1980

Related U.S. Application Data

[63] Continuation of Ser. No. 93,354, Nov. 13, 1979, Pat. No. T100,301.

[51] Int. Cl.[3] ..... B03D 1/00

[52] U.S. Cl. ..... 209/166

[58] Field of Search ..... 209/166, 167

[56] References Cited

U.S. PATENT DOCUMENTS

| | | | |
|---|---|---|---|
| 2,165,268 | 7/1939 | Vogel-Jorgensen | 209/166 |
| 2,173,909 | 9/1939 | Kritchevsky | 209/166 |
| 3,260,365 | 7/1966 | Dickson | 209/166 |
| 3,779,380 | 12/1973 | Bishop | 209/166 |
| 4,069,235 | 1/1978 | Suzuki | 260/407 |
| 4,139,487 | 2/1979 | Holme | 209/166 X |

OTHER PUBLICATIONS

Chem. Abst., 64, 1966, 6158h.

Chem. Abst., 85, 1976, 7806f.

*Primary Examiner*—Robert Halper

*Attorney, Agent, or Firm*—Robert A. Petrusek

[57] ABSTRACT

A phosphate ore fllotation process subjects a phosphate ore containing silica and silicates to froth flotation in the presence of a collector, said collector being a $C_{36}$ high molecular weight dibasic acid comprising two carboxylic functional groups, recovering the phosphate concentrate from the overflow, and removing the separated silica and silicates in the underflow. The dibasic acids should be used in conjunction with fuel oil, not only to reduce the reagent consumption, but also to increase the grade and recovery of phosphate concentrate. The selectivity of some of these collectors is so great than an acceptable phosphate rock concentrate can be obtained from the phosphate ore in a single anionic circuit.

1 Claim, No Drawings

PHOSPHATE FLOTATION WITH DIBASIC ACIDS

The invention herein described may be manufactured and used by or for the Government for governmental purposes without the payment to me of any royalty therefor.

This application is a continuation of copending application Ser. No. 93,354, filed Nov. 13, 1979, for PHOSPHATE FLOTATION WITH DIBASIC ACIDS, now T100,301, Feb. 3, 1981.

The present invention relates to a phosphate ore flotation process and more particularly the present invention relates to the use of $C_{36}$ dibasic acids as substitutes for commercial tall oil mixtures of fatty acids or oleic acid in the phosphate rock flotation.

Current beneficiation practices for phosphate ores commonly utilize flotation as the principal step for separating phosphates from gangue minerals. One significant cost factor in beneficiation is that of the flotation reagents. Reagent costs have increased in recent years due to a growing scarcity of adequate supplies of tall oil. Reagent consumption per ton of product also has increased as industry is forced to mine and process lower grade ores. Therefore, one of the principal objects of the present invention is to provide substitute flotation reagents with excellent collecting efficiency and reasonable cost.

Most natural deposits of phosphate rock, such as those found in Florida, contain an objectionably high percentage of silica and silicates. Typical Florida ore as mined will contain approximately one-third phosphate mineral, one-third silica or siliceous gangue, and one-third clay. In the processing of these ores, they are first subjected to washing and screening operations in the "washer plant" to remove the clay constituents as slime and to recover coarse, pebble concentrate. Deslimed undersize (essentially −14 mesh to +150 mesh) from the screening operation is further separated at about 35 mesh. The coarse fraction is conditioned with tall oils and fuel oils and treated on concentrating tables, spiral concentrators, or spray belts. The fine mineral fraction is subjected to the Crago or "double-float" process which utilizes two stages of froth flotation. In the first stage, the flotation feed is conditioned in the anionic circuit with caustic soda, fuel oil, tall oil mixtures of fatty acids, or oleic acid. The conditioned feed is then subjected to froth flotation where phosphates are floated and the underflow is discarded to waste. The product obtained from this flotation operation normally still contains so much silica that further treatment is necessary.

Accordingly, this intermediate product is de-oiled by scrubbing with sulfuric acid followed by desliming. The de-oiled, deslimed product is then subjected to a second stage of froth flotation in a cationic circuit with amines, where the silica is floated and discarded to waste. The underflow of the second stage of flotation is the final phosphate product.

The tall oils and commercial fatty acids used in the foregoing process consist mainly of $C_{12}$ to $C_{18}$ saturated and unsaturated fatty acids. U.S. Pat. No. 3,859,207, Knocke et al teach that $C_{20}$ to $C_{22}$ saturated and unsaturated fatty acids may be utilized in the phosphate flotation. These fatty acids are monobasic, i.e., they consist of one functional carboxylic group. On the other hand, the reagents used in the present invention are $C_{36}$ high molecular weight dibasic acids which consist of two functional carboxylic groups.

The literature reveals that the $C_{20}$ dicarboxylic acids, such as 2-tetradecyladipic acid, are effective apatite collectors in the flotation of igneous nepheline syenite phosphate ore (*Chemical Abstract* 85, 7806f, 1976). However, not all high molecular weight dicarboxylic acids are satisfactory phosphate flotation reagents. For example, I have found that $C_{21}$ cyclohexenedi-carboxylic acid is not a good phosphate collector because of its poor selectivity; it tends to float not only phosphate but also silica.

The preferred class of dibasic acids used in the present invention is dimer acids which consist mainly of $C_{36}$ aliphatic, dicarboxylic acids with two alkyl side chains. These reagents may also contain monobasic and tribasic acids. During the experimental work leading to the present invention, I found that the high molecular weight dibasic acids employed in conjunction with fuel oil or other hydrocarbons readily adapt themselves for a flotation process wherein the phosphate rock is floated as the concentrate while the undesired silica and silicates remain in the tailing. I further discovered that the selectivity of this collector is so great that an acceptable phosphate rock concentrate can be prepared from the phosphate ore in a single anionic circuit.

The present invention may be practiced in a manner analogous to the first flotation stage of the present double-float process. The cationic amine cleaning process in the second flotation stage may not be necessary if a sufficient grade of phosphate concentrate is obtained. The flotation feed can be prepared for flotation in the usual way, being first washed and sized and then deslimed. The desliming can be performed on materials of as low as 400 mesh rather than at 150 mesh, as practiced in the present phosphate industry. The deslimed silica-containing phosphate ore flotation feed can be subjected to froth flotation in the same kind of flotation equipment presently employed. Necessarily, the flotation feed will first be conditioned with the chemical agents including collector, auxiliary collector, frother, pH regulator, or other chemical agents. The desired phosphate concentrate will be floated and removed in the froth, while the silica and silicates will be removed in the underflow or tailing. If desired, the concentrate can be passed to one or more additional cells in the same flotation circuit for the cleaning process. This cleaning process will not require the addition of further collector beyond the initial conditioning of the flotation feed.

By this procedure just described, a phosphate ore flotation feed containing about 70 percent silica matter by weight can be processed to obtain a product containing about 3 percent silica in combination with 90 percent of $P_2O_5$ recovery when $C_{36}$ dimer acids are used. For most commercial purposes, a product of satisfactory grade can be obtained by the single anionic flotation circuit procedure. The improvement of reducing the silica content also can be obtained by subjecting the product to a cationic-type flotation wherein the silica is floated as in the second stage of the present double-float process. The present invention is further illustrated by the following examples.

EXAMPLE 1

A Florida phosphate ore containing 8.9 percent $P_2O_5$ was used in this example. The minus 28 plus 400-mesh fraction which was used as flotation feed contains only 9.1 percent $P_2O_5$ and as high as 70 percent silica and silicates. A 500-gram flotation feed was inroduced into the Denver (Model No. D-12) laboratory conditioning equipment, and the pulp density was adjusted to about 65 percent solids (by weight) by the addition of sufficient water. The pH was then adjusted to an alkaline reading by using NaOH. The $C_{36}$ aliphatic, decarboxylic acid (Hystrene 3695 dimer acid) and fuel oil were added as collector and auxiliary collector, respectively. The impeller speed for conditioning was 500 rpm and the conditioning time was five minutes. The pH was measured at the end of the conditioning. After conditioning, the pulp was transferred to a Denver 500-gram flotation cell and diluted with sufficient tap water. The pulp was then floated for two or three minutes to collect phosphate concentrate. Silica and silicates remained in the sink as tailing. The concentrate and tail were then filtered, oven dried, and analyzed. The flotation results are recorded in table I below:

TABLE I

| Test No. | Reagent, lb/ton feed: Dibasic acid | Fuel oil | Conditioning pH | Product: Name | Wt. % | Assay, %: $P_2O_5$ | Acid insoluble | Distribution, %: $P_2O_5$ | Acid insoluble |
|---|---|---|---|---|---|---|---|---|---|
| 1 | 0.96 | 1.82 | 8.4 | C[a] | 28.8 | 29.4 | 7.1 | 88.9 | 8.0 |
| | | | | Tail | 71.2 | 1.48 | 93.9 | 11.1 | 97.0 |
| 2[b] | 0.72 | 1.44 | 10.5 | C[a] | 29.5 | 29.5 | 7.3 | 92.7 | 3.1 |
| | | | | Tail | 70.5 | 0.97 | 95.7 | 7.3 | 96.9 |

[a]C = concentrate.
[b]0.089 lb/ton pine oil was added as frother.

EXAMPLE II

The phosphate ore flotation was performed as outlined in Example I, supra, except that additional tall oil was used. The flotation results are recorded in Table II below:

TABLE II

| Test No. | Reagent, lb/ton feed: Dibasic acid | Tall oil | Fuel oil | Conditioning pH | Product: Name | Wt. % | Assay, %: $P_2O_5$ | Acid insoluble | Distribution, %: $P_2O_5$ | Acid insoluble |
|---|---|---|---|---|---|---|---|---|---|---|
| 3 | 0.48 | 0.48 | 0.96 | 10.1 | C[a] | 41.4 | 21.4 | 31.2 | 96.1 | 18.7 |
| | | | | | Tail | 58.6 | 0.62 | 96.5 | 3.9 | 81.3 |

[a]C = concentrate.

EXAMPLE III

The phosphate ore flotation was performed as outlined in Example I supra except that additional saturated branched-chain monobasic fatty acid was used. The flotation results are recorded in Table III below:

TABLE III

| Test No. | Reagent, lb/ton feed: Dibasic Acid | BCMA[a] | Fuel oil | Conditioning pH | Product: Name | Wt. % | Assay, %: $P_2O_5$ | Acid insoluble | Distribution, %: $P_2O_5$ | Acid insoluble |
|---|---|---|---|---|---|---|---|---|---|---|
| 4 | 0.48 | 0.49 | 0.96 | 10.0 | C[b] | 31.4 | 27.2 | 13.9 | 94.0 | 6.2 |
| | | | | | Tail | 68.6 | 0.80 | 95.8 | 6.0 | 93.8 |

[a]BCMA = branched-chain monobasic acid (isostearic acid was used).
[b]C = concentrate.

EXAMPLE IV

The phosphate ore flotation was performed as outlined in Example I, supra, except that the rougher concentrate was further cleaned to increase the $P_2O_5$ content in the final concentrate. The rougher concentrate, as outlined according to the process outlined in Example I, supra, was returned to the 250-gram flotation cell with sufficient water for further cleaning. The phosphate was refloated as the cleaner concentrate. No additional reagent was necessary during the flotation cleaning process. The cleaner tail fraction (middling) in the sink normally would be returned to a rougher flotation circuit. The results are presented in Table IV below:

TABLE IV

| Test No. | Reagent, lb/ton feed: Dibasic acid | Fuel oil | Conditioning pH | Product: Name | Wt. % | Assay, %: $P_2O_5$ | Acid insoluble | Distribution, %: $P_2O_5$ | Acid insoluble |
|---|---|---|---|---|---|---|---|---|---|
| 5 | 0.96 | 1.82 | 10.2 | C[a] | 25.3 | 30.8 | 3.4 | 84.8 | 1.2 |
| | | | | M[b] | 3.1 | 17.1 | 43.1 | 5.8 | 1.9 |
| | | | | Tail | 71.6 | 1.21 | 94.2 | 9.4 | 96.9 |

[a]C = concentrate.
[b]M = middling.

As demonstrated from my experiments of the present invention, $C_{36}$ high molecular weight dibasic acids with two carboxylic groups can be used as substitutes for tall oils or other commercial fatty acids in the phosphate rock flotation. The dibasic acids should be used in conjunction with fuel oil, not only to reduce the reagent consumption, but also to increase the grade and recovery of phosphate concentrate. Using $C_{36}$ dibasic acids as collector, the $P_2O_5$ recovery can be more than 90 percent in the rougher circuit and can be as high as 90 percent after one stage of a cleaning process, assuming that 90 percent of the $P_2O_5$ content in the cleaner tail (middling fraction) reported to the cleaner concentrate in a continuous system. Cationic flotation circuit in the "double-float" process can be eliminated if $C_{36}$ dibasic acids are used.

While I have shown and described particular embodiments of my invention, modifications and variations thereof will occur to those skilled in the art. I wish it to be understood, therefore, that the appended claims are intended to cover such modifications and variations which are with the true scope and spirit of my invention.

What I claim as new and desire to secure by Letters Patent of the United States is:

1. An ore flotation process comprising the steps of
(1) subjecting a phosphate ore containing silica and silicates to froth flotation in the presence of a collector, said collector consisting essentially of $C_{36}$ high molecular weight dibasic acids comprising two carboxylic groups;
(2) recovering the phosphate concentrate from the overflow; and
(3) removing the separated silica and silicates in the underflow.

* * * * *